US010337323B2

(12) United States Patent
Krüger et al.

(10) Patent No.: US 10,337,323 B2
(45) Date of Patent: Jul. 2, 2019

(54) DUAL FUNCTION DOWNHOLE TOOL

(71) Applicant: WELLTEC A/S, Allerød (DK)

(72) Inventors: Christian Krüger, Allerød (DK); Peter Gråbæk, Allerød (DK)

(73) Assignee: Welltec A/S, Allerød (DK)

( * ) Notice: Subject to any disclaimer, the term of this patent is extended or adjusted under 35 U.S.C. 154(b) by 178 days.

(21) Appl. No.: 15/316,949

(22) PCT Filed: Jun. 10, 2015

(86) PCT No.: PCT/EP2015/062885

§ 371 (c)(1),
(2) Date: Dec. 7, 2016

(87) PCT Pub. No.: WO2015/189239

PCT Pub. Date: Dec. 17, 2015

(65) Prior Publication Data

US 2017/0114636 A1 Apr. 27, 2017

(30) Foreign Application Priority Data

Jun. 11, 2014 (EP) ..... 14171978

(51) Int. Cl.
*E21B 23/00* (2006.01)
*E21B 27/02* (2006.01)
*E21B 49/08* (2006.01)

(52) U.S. Cl.
CPC ..... *E21B 49/082* (2013.01); *E21B 23/00* (2013.01); *E21B 27/02* (2013.01); *E21B 49/081* (2013.01); *E21B 2023/008* (2013.01)

(58) Field of Classification Search
CPC .. E21B 49/10; E21B 49/081; E21B 2023/008; E21B 21/10; E21B 23/00; E21B 27/02; E21B 34/08; E21B 49/082
See application file for complete search history.

(56) References Cited

U.S. PATENT DOCUMENTS 3,126,060 A * 3/1964 Loiacano ..... E21B 21/10 137/515
3,273,647 A 9/1966 Briggs, Jr. et al.
(Continued)

FOREIGN PATENT DOCUMENTS

RU 2 294 431 C1 2/2007
RU 2 492 323 C1 9/2013
WO WO 94/00671 1/1994

OTHER PUBLICATIONS

International Search Report and Written Opinion of the ISA for PCT/EP2015/062885 dated Oct. 12, 2015, 13 pages.
(Continued)

*Primary Examiner* — Daniel P Stephenson
(74) *Attorney, Agent, or Firm* — Nixon & Vanderhye P.C.

(57) ABSTRACT

A wireline tool for sampling/jetting fluid in a well includes a pump with an opening, and a chamber for collecting/jetting fluid, the chamber having first and second ends. The chamber includes first and second pistons dividing the chamber into first, second and third chamber sections. The first and second pistons are attached to respective piston rods, and the rods are supported by respective supports. A first spring is provided between the first piston and its support and another spring is provided between the second piston and its support. When the pump operates, the pistons are forced in one direction, hence activating spring forces of the springs and allowing fluid to flow from one chamber section to another chamber section.

17 Claims, 12 Drawing Sheets

(56) References Cited

U.S. PATENT DOCUMENTS 3,692,106 A * 9/1972 Basham ..... E21B 27/02 166/104
3,741,302 A * 6/1973 Brown ..... E21B 17/06 166/208
4,470,464 A * 9/1984 Baldenko ..... E21B 4/02 137/115.06
4,856,585 A * 8/1989 White ..... E21B 34/108 166/323
5,377,755 A * 1/1995 Michaels ..... E21B 49/10 166/264
6,289,990 B1 * 9/2001 Dillon ..... E21B 34/08 166/319
9,416,606 B2 * 8/2016 Harms ..... E21B 34/066
2002/0129936 A1 * 9/2002 Cernosek ..... E21B 49/082 166/264
2005/0098322 A1 * 5/2005 Balen ..... E21B 37/10 166/369
2008/0066904 A1 * 3/2008 Van Hal ..... E21B 36/008 166/250.1
2009/0025930 A1 * 1/2009 Iblings ..... E21B 19/16 166/244.1
2009/0294177 A1 * 12/2009 Chan ..... E21B 17/18 175/57
2010/0258297 A1 * 10/2010 Lynde ..... E21B 37/00 166/105.1
2010/0319779 A1 12/2010 Harms et al.
2011/0011583 A1 * 1/2011 Niconoff ..... E21B 43/08 166/264
2016/0298419 A1 * 10/2016 Woodford ..... E21B 34/08
2017/0114636 A1 * 4/2017 Kruger ..... E21B 27/02

OTHER PUBLICATIONS

Extended European Search Report for EP14171978.1 dated Nov. 26, 2014, 9 pages.

Office Action of Substantive Examination dated Dec. 20, 2018 in Russian Application No. 2016151511/03(082586), with English translation (12 pages).

* cited by examiner

A-A

DUAL FUNCTION DOWNHOLE TOOL

This application is the U.S. national phase of International Application No. PCT/EP2015/062885 filed Jun. 10, 2015 which designated the U.S. and claims priority to EP Patent Application No. 14171978.1 filed Jun. 11, 2014, the entire contents of each of which are hereby incorporated by reference.

FIELD OF THE INVENTION

The present invention relates to a multifunctional downhole wireline tool for fluid sampling and fluid jetting in a well downhole. The present invention further relates to a downhole system for fluid sampling and fluid jetting in a well downhole and to a sampling method and a jetting method using a multifunctional downhole wireline tool according to the present invention.

BACKGROUND ART

When performing an operation downhole, a tool string is rigged up to perform a specific operation, and in order to perform a second operation, it is required that the tool string is brought to surface to be re-rigged with another tool to perform the second operation. Both the re-rigging and the transport of the tool string to and from surface between two operations are time-consuming and thus expensive, as the oil rig is not producing during the operations.

SUMMARY OF THE INVENTION

It is an object of the present invention to wholly or partly overcome the above disadvantages and drawbacks of the prior art. More specifically, it is an object to provide an improved downhole tool capable of performing several operations without having to be brought to surface for re-rigging.

The above objects, together with numerous other objects, advantages and features, which will become evident from the below description, are accomplished by a solution in accordance with the present invention by a multifunctional downhole wireline tool for fluid sampling and fluid jetting in a well downhole, comprising:

- a pump having a pump opening, and
- a fluid chamber for collecting a sample of fluid or storage of fluid to be jetted, the fluid chamber having a first chamber end connected with the pump opening and a second chamber end having a chamber opening for fluid communication with the well, wherein the fluid chamber has a chamber wall and comprises:

- a first piston and a second piston dividing the fluid chamber into a first chamber section, a second chamber section and a third chamber section, the first piston being connected with a first end of a first piston rod, the second piston being connected with a first end of a second piston rod,
- a first support configured to support the first piston rod,
- a second support configured to support the second piston rod, and
- a first spring provided between the first piston and the first support and another first spring provided between the second piston and the second support, so that when the pump provides a pressure difference over the pistons, the pistons are forced in one direction, hence activating a spring force of the first springs and allowing the fluid to flow from one chamber section to another chamber section for collecting a sample of fluid in at least the first or the third chamber section or for jetting of a fluid provided at least in the second chamber section.

By arranging the spring between the piston and the support, the spring force is activated so that when the pump stops, the piston is forced into its initial closed position, hence sealing off the second chamber section. The second chamber section is thus also sealed off when transporting the fluid to be jetted.

Moreover, the pump may provide a suction pressure in the first chamber section, and the piston may be forced in the one direction towards the pump, allowing the fluid to flow from the second chamber section to the first chamber section and from the third chamber section to the second chamber section, respectively. When the pump provides a suction pressure in the first chamber section, fluid is sucked into the third chamber.

Also, the pump may provide a compressive pressure in the first chamber section, and the piston may be forced in an opposite direction away from the pump, allowing the fluid to flow from the first chamber section to the second chamber section and from the second chamber section to the third chamber section, respectively.

When the pump provides a compressive pressure in the first chamber section, fluid is jetted out of the third chamber.

The multifunctional downhole wireline tool as described above may further comprise a second spring abutting the supports and connected with a second end of the piston rods.

Furthermore, the piston may be arranged at one side of the support and the first end of the piston rod may penetrate an aperture in the support, the second end of the piston rod being arranged at an opposite side of the support.

Each support may have at least one through-bore allowing fluid to flow from one chamber section to another.

Further, each support may have at least one recess which provides access for fluid to flow from one chamber section to another chamber section.

In addition, the chamber wall may comprise at least a first circumferential protrusion arranged opposite one of the pistons in a closed position of the piston, providing a seal between two chamber sections.

Moreover, the at least first circumferential protrusion may taper towards the first and second ends of the chamber.

Also, the chamber wall may comprise at least one groove arranged along a longitudinal extension of the fluid chamber, the groove being arranged opposite the piston in an open position of the piston where fluid is allowed to flow from one chamber section to another.

Additionally, the groove may be circumferential.

Further, the chamber wall may comprise two grooves, one groove arranged on one side of the piston and the other groove arranged on the other side of the piston when the piston is in its closed position.

Furthermore, the second end of the piston rods may comprise a projection connecting the second spring with the second end.

Additionally, a tool housing defining the chamber wall may comprise at least two housing parts, which housing parts are detachably connected to each other opposite the second chamber section.

Further, the second chamber section may have an outlet provided with a detachable plug for taking out the sample at surface or filling the second chamber section with the fluid to be jetted.

Moreover, pistons may have a first piston diameter nearest the ends of the fluid chamber, a second piston diameter nearest the second chamber section, a circumferential groove arranged between the first piston diameter and the second piston diameter, and a sealing element arranged in the groove, the second piston diameter being smaller than the first piston diameter, allowing fluid from the second chamber to pass the second piston diameter and force the sealing element towards the chamber wall.

Having a second piston diameter which is smaller than the first piston diameter, the fluid sample having a pressure which is substantially higher than the well fluid pressure as the tool returns to the top of the well, helps press the sealing element outwards, thus providing a better seal between the second chamber section and the other chamber sections as the pressure difference between the fluid sample and the surrounding well fluid increases.

Additionally, a shear pin or shear disc may be arranged in a groove in the piston rod to prevent the piston from unintentional sliding.

Furthermore, an inner face of the chamber and a face of the pistons may comprise a layer of ceramics, such as $S_tO$ or glass.

The present invention also relates to a downhole system for fluid sampling and fluid jetting in a well downhole, comprising:

- a multifunctional downhole wireline tool as described above, and
- a downhole driving unit, such as a downhole tractor for propelling the system forward in the well.

The present invention further relates to a sampling method using a multifunctional downhole wireline tool as described above, comprising the steps of:

- arranging the tool in the well at a predetermined position,
- providing a suction pressure in the first chamber section by means of the pump,
- forcing the first piston towards from the pump allowing well fluid from the second chamber section into the first chamber section, and
- forcing the second piston towards the pump, allowing well fluid from the third chamber section into the second chamber section, sucking well fluid through the opening in the second end of the fluid chamber into the third chamber section and further into the second chamber section.

Finally, the present invention relates to a jetting method using a multifunctional downhole wireline tool as described above, comprising the steps of:

- filling the second chamber section with fluid,
- arranging the tool in the well at a predetermined position,
- providing a compressive pressure in the first chamber section by means of the pump,
- forcing the first piston away from the pump, allowing well fluid from the pump into the second chamber section, and
- forcing the second piston away from the pump, allowing well fluid from the second chamber section into the third chamber section and out through the opening in the second end of the fluid chamber.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
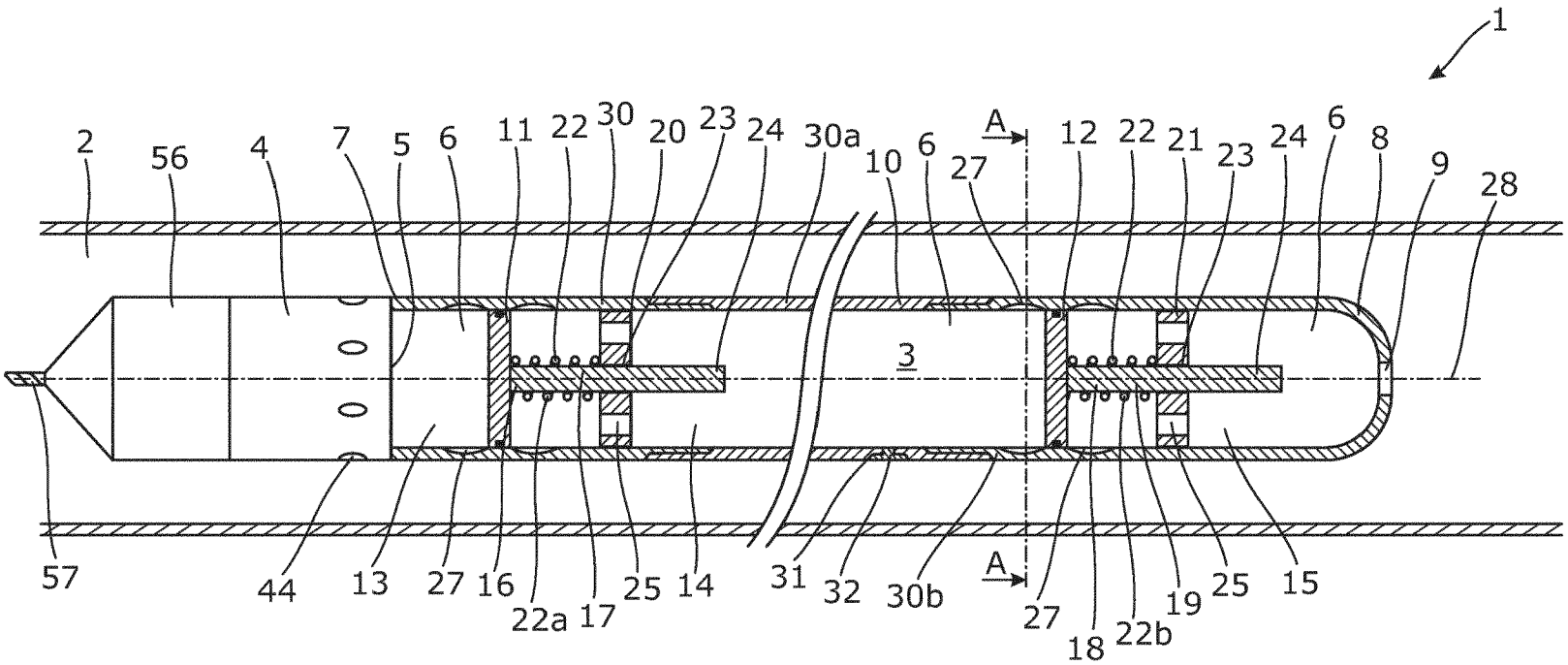
FIG. 1 shows a cross-sectional view of a multifunctional downhole wireline tool.

FIG. 1 shows a multifunctional downhole wireline tool 1 for fluid sampling and/or fluid jetting in a well 2 downhole. The dual function of the tool may be performed in one run. The multifunctional downhole wireline tool 1 comprises a pump 4 having a pump opening 5 and the pump is connected with a fluid chamber 6 comprised in a tool housing 30. The fluid chamber is used for collecting a sample of fluid 3 downhole or storage of fluid 3 to be jetted downhole. The fluid chamber 6 has a first chamber end 7 fluidly connected with the pump opening 5 through the pump 4 and a second chamber end 8 having a chamber opening 9 arranged nearest a bottom of the well 2 and configured to provide fluid communication with the surroundings of the tool. The fluid chamber 6 has a chamber wall 10 and comprises a first piston 11 and a second piston 12 dividing the fluid chamber into a first chamber section 13, a second chamber section 14 and a third chamber section 15. The first chamber section 13 is fluidly connected with the pump 4 and the third chamber section 15 is fluidly connected with the opening 9. The first piston 11 is connected with a first end 16 of a first piston rod 17, and the second piston is connected with a first end 18 of a second piston rod 19. A first support 20 is arranged slidably along the first piston rod 17 for supporting the first piston rod, and a second support 21 is arranged slidably along the second piston rod 19 for supporting the second piston rod. A first spring 22, 22*a* is provided between the first piston 11 and the first support 20, and another first spring 22, 22*b* is provided between the second piston 12 and the second support 21, so that when the pump 4 creates a pressure difference over the pistons, the pistons are forced in one direction, hence activating a spring force of the first springs and allowing the fluid to flow from one chamber section to another chamber section.

By having two pistons which are mechanically activated by the pumping direction, a fluid chamber section is provided between the pistons capable of entrapping a fluid, i.e. sucking in a fluid sample or entrapping a fluid to be ejected through the chamber opening. Thus, fluid to be jetted out of the tool downhole is arranged at least in the second chamber section and a fluid sample from the well is sucked into at least the first chamber section and/or the third chamber section. When operating, the tool sucks fluid into preferably all chamber sections, or the tool jets fluid entrapped in at least the second chamber section and preferably also fluid entrapped in the first and in the third chamber sections out of the tool. Fluid to be jetted, such as ethanol, does not mix naturally with the well fluid e.g. during transport, so even if the third chamber section was filled with ethanol fluid, the fluid would not mix even though the third chamber section was open to the well surroundings. The pump keeps pumping the fluid in the first chamber section or in the third chamber section, depending on which pump direction is jetted out of the tool. In the same manner, fluid is preferably sucked into the first, the second and the third chamber sections at least until a fluid sample is entrapped in the second chamber section.

Arranging the piston between the piston and the support provides a simple mechanical solution where the spring force is activated so that when the pump is not running, the piston is forced into its initial closed position, hence sealing off the second chamber section, i.e. the fluid chamber section entraps the fluid sample or the fluid to be ejected into the well.

Figure 2:
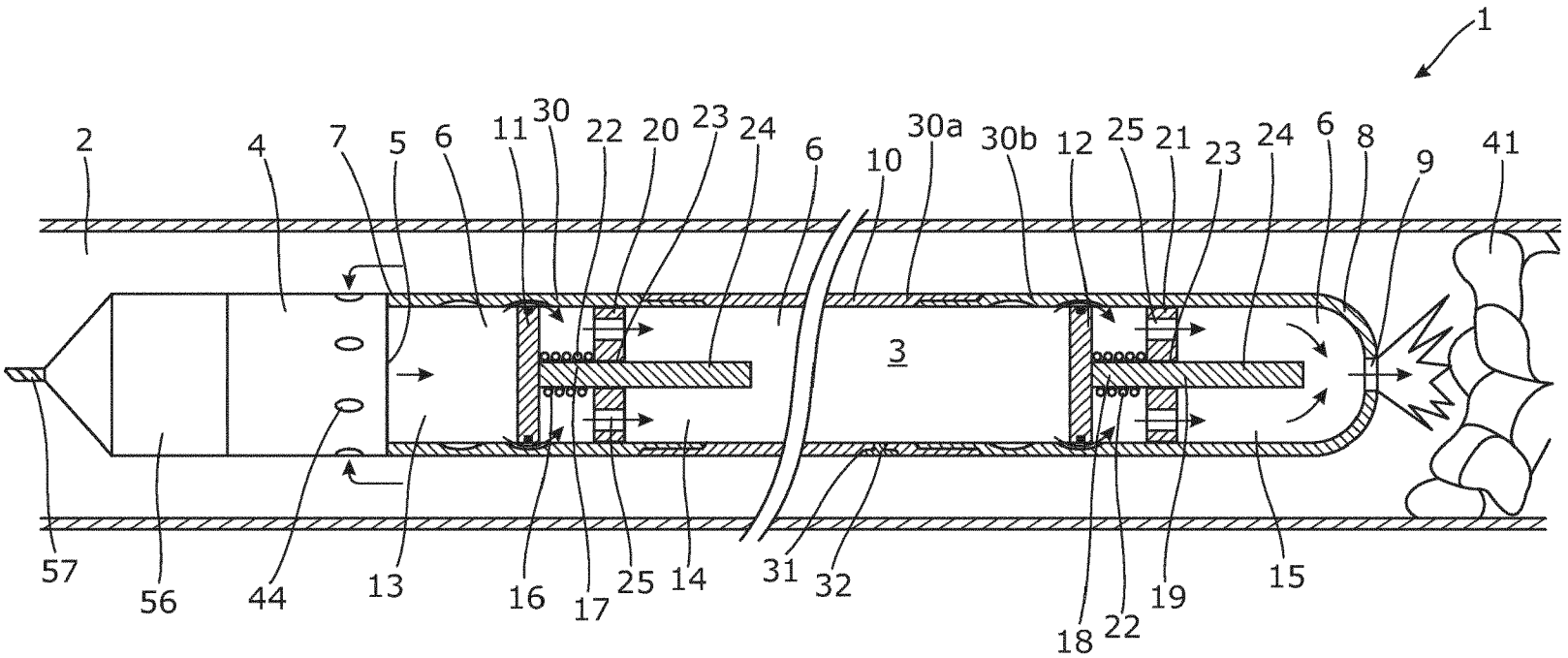
FIG. 2 shows the multifunctional downhole wireline tool of FIG. 1 in jetting mode.

When ejecting or jetting a fluid to e.g. dissolve a hydrate plug 41 in the well 2, as shown in FIG. 2, the second chamber section 14 is filled with fluid, e.g. ethanol, and the tool 1 is arranged in the well 2 opposite the hydrate plug 41. Then the pump 4 is activated to provide a compressive pressure, whereby the first piston 11 is forced in an opposite direction away from the pump 4, allowing the fluid to flow from the first chamber section 13 to the second chamber section 14, while the second piston 12 is also moved away from the pump 4, allowing fluid to flow from the second chamber section 14 to the third chamber section 15, as indicated by arrows. Well fluid surrounding the tool 1 is, in this way, sucked in through outlets 44 of the pump into the first chamber section 13, past the first piston 11 and through the first support 20 into the second chamber section 14 and mixed with the ethanol-containing fluid. The mixed fluid 3 in the second chamber section 14 flows past the second piston 12 into the third chamber section 15, then through the second support 21 and out through the opening 9 in the second chamber end 8 and is then jetted towards the hydrate plug 41 to dissolve the same. The second chamber section 14 may at surface be filled with a variety of cleaning fluids depending on the purpose of the jetting operation. The opening 9 may be provided with a shear disc, a flapping element, a valve etc. Furthermore, the jetting may also occur through the outlets 44 of the pump depending on the pumping direction. However, if the fluid to be pumped out of the tool is an acid, the fluid is jetted out of the opening 9, so that the acid does not enter the pump.

Figure 3:
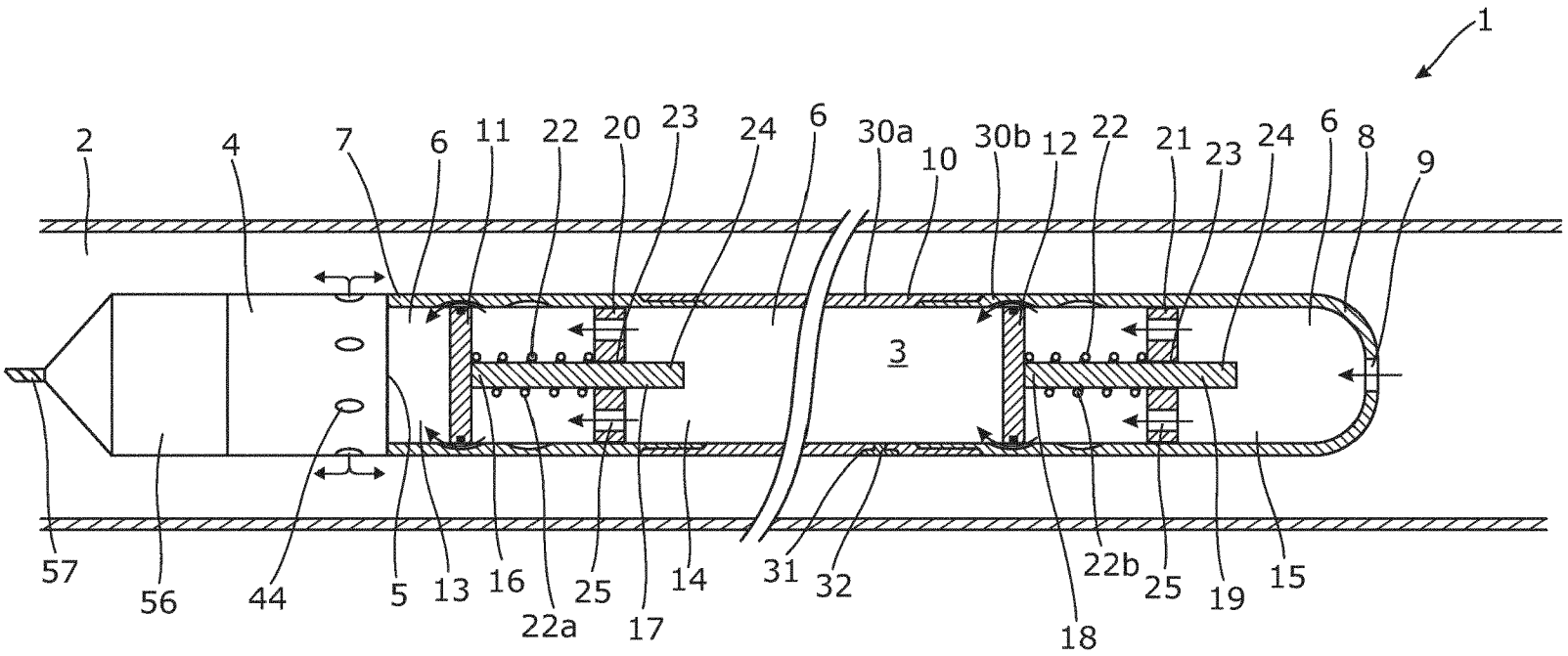
FIG. 3 shows the multifunctional downhole wireline tool of FIG. 1 in sampling mode.

When taking a sample downhole, the tool 1 is submerged into the well 2 and arranged in a predetermined position in which the sample is to be taken. Then, the pump 4 provides a suction pressure, whereby the first piston 11 is forced in a direction towards the pump 4, as shown in FIG. 3, allowing the fluid to flow from the second chamber section 14 to the first chamber section 13, while the second piston 12 is also moved towards the pump 4, allowing fluid to flow from the third chamber section 15 to the second chamber section 14, as indicated by arrows. Well fluid surrounding the tool 1 is, in this way, sucked into the fluid chamber 6 through the chamber opening 9, into the third chamber section 15 past the second support 21, then past the second piston 12 and further into the second chamber section 14. Fluid in the second chamber section 14 passes the first support 20, then the first piston 11, and then flows into the pump opening 5 and out through outlets 44 in the pump 4. The pump continues to pump fluid into the fluid chamber 6 to make sure that all fluid present in the tool 1 at surface is exchanged with well fluid, and then the pump is stopped and the spring force forces the first and second pistons 11, 12 back to their closed positions, hence sealing off the second chamber section 14 comprising the fluid sample. Furthermore, the sampling may also occur through the outlets 44 of the pump, depending on the pumping direction.

The pump is driven by an electrical motor 56 powered by electricity fed through the wireline 57. In order to shift the pump from providing a suction pressure to providing a compressive pressure, the rotation of the pump just needs to be shifted, which shift may be performed downhole without having to bring the tool to surface, and thus at lot of operation time is saved.

As shown in FIGS. 1-3, the first piston 11 is arranged at one side of the first support 20, and the first end 16 of the second piston rod 19 penetrates an aperture 23 in the first support. The second end 24 of the first piston rod 17 is arranged at an opposite side of the first support 20. The second piston 12 is in the same way arranged at one side of the second support 21, and the first end 18 of the second piston rod 19 penetrates an aperture 23 in the second support 21. The second end 24 of the first piston rod is arranged at an opposite side of the first support 20. The supports are, in this way, capable of supporting and controlling the piston rods while moving along with the pistons back and forth in relation to the pump.

In order to allow fluid to flow past the supports, each support has at least one through-bore 25 allowing the fluid to flow from one chamber section to another chamber section when the pistons are in their open positions. Thus, even though the pistons are in their closed positions, the fluid can pass through the supports.

Figure 4:
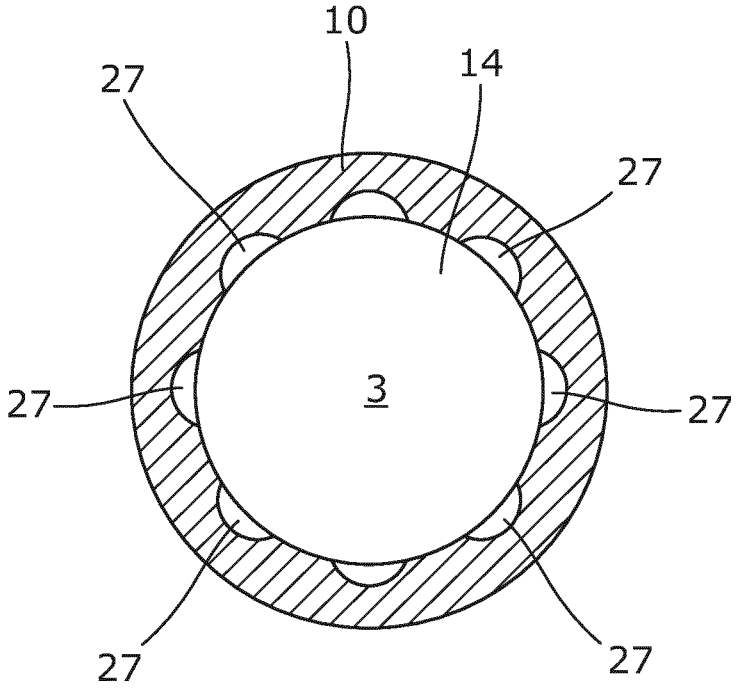
FIG. 4 shows a cross-section along line A-A in FIG. 1.

In FIGS. 1-3, the fluid is capable of passing the pistons when the pistons are in their open positions, as shown in FIGS. 2 and 3, because the chamber wall comprises at least two grooves 27 arranged along a longitudinal extension 28 (shown in FIG. 1) of the fluid chamber 6. One groove is arranged on one side of the piston when the piston is in its closed position, as shown in FIG. 1, and the other groove is arranged on the other side of the piston. In order to provide fluid access past the pistons, the pistons are arranged opposite the grooves in the open position of the piston. FIG. 4 is a cross-section of FIG. 1 taken along line A-A, showing the arrangements of the grooves 27.

The characteristic of the spring may be dimensioned to fit the downhole pressure so that the pistons are maintained in their sealed and closed positions while moving the tool up or down the well, entrapping the fluid in the second chamber section, even though the well pressure varies.

Figure 6:
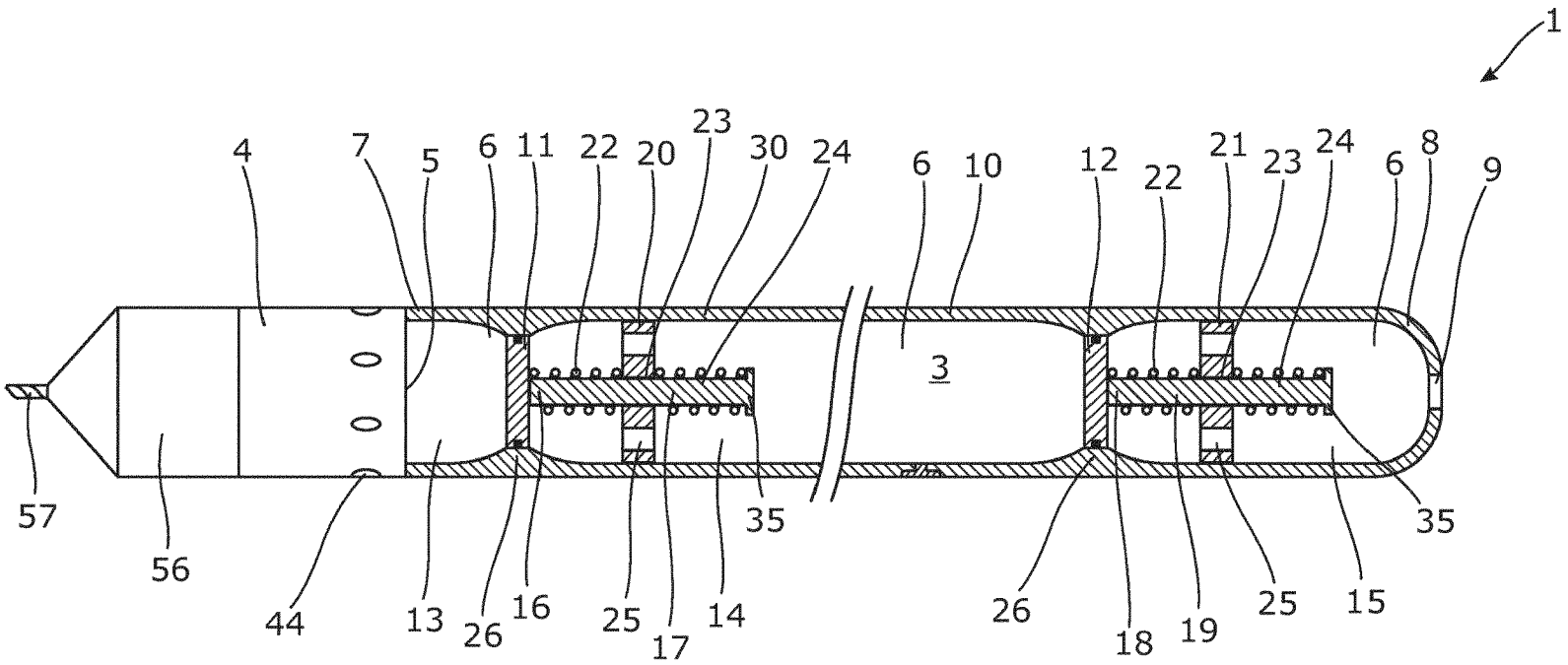
FIG. 6 shows a cross-sectional view of yet another multifunctional downhole wireline tool.

In FIG. 1, the first support 20 is arranged in the second chamber section 14 and the second support 21 is arranged in the third chamber section 15. In FIG. 6, the first support 20 is arranged in the first chamber section 13 and the second support 21 is arranged in the second chamber section 14.

In FIGS. 1-3, the tool housing 30 defining the chamber wall comprises at least two housing parts 30*a*, 30*b*. The housing parts are detachably connected to each other opposite the second chamber section 14, so that a fluid sample may be collected from the second chamber section 14 by demounting the two housing parts 30*a*, 30*b*. The second chamber section may also be emptied or filled through an outlet 31 provided with a detachable plug 32 for taking out the sample at surface or filling the second chamber section 14 with the fluid to be jetted. Upon removing the pistons, both the first and/or the third chamber section can be emptied as well.

Figure 5:
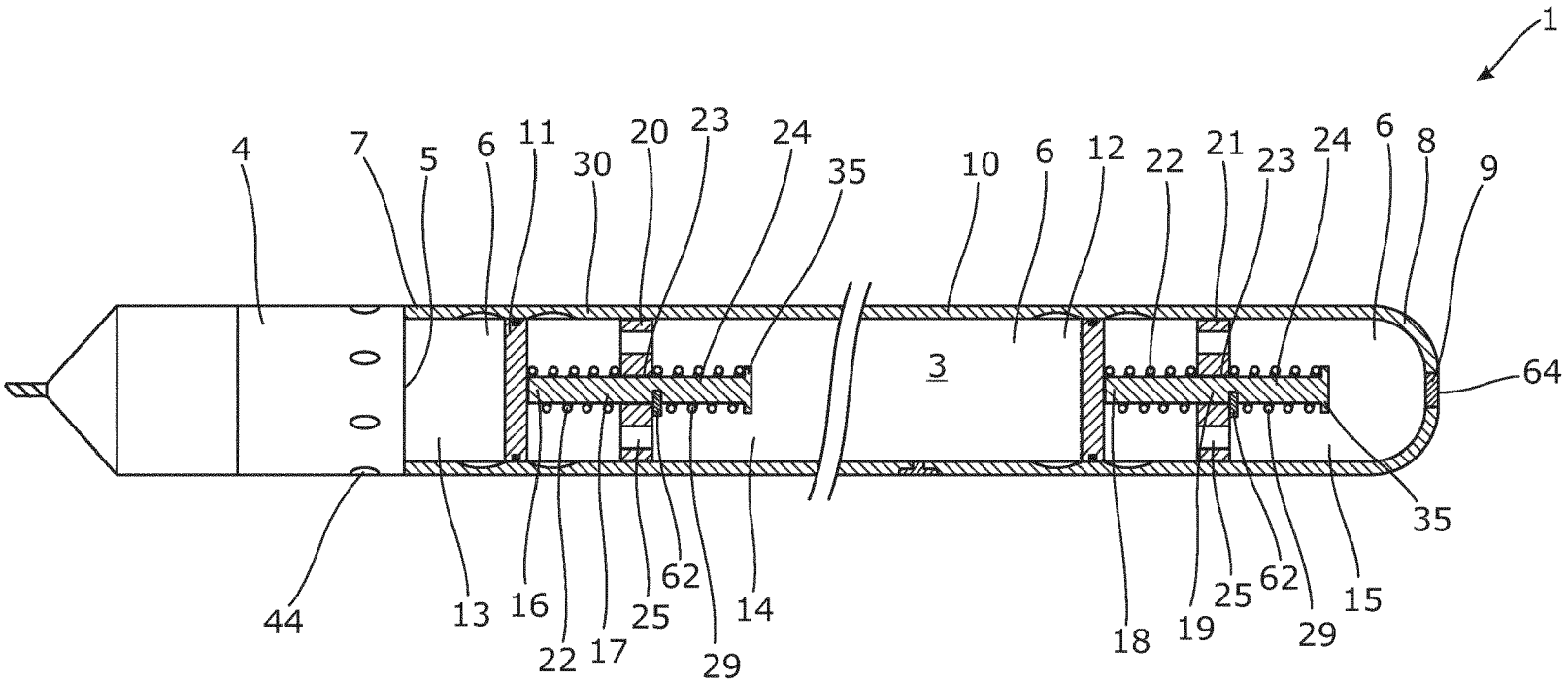
FIG. 5 shows a cross-sectional view of another multifunctional downhole wireline tool.

In FIG. 5, the multifunctional downhole wireline tool 1 further comprises a second spring 29 abutting the first support 20 and connected with a second end 24 of the first piston rod 17, and another second spring 29 abutting the second support 21 and connected with a second end 24 of the second piston rod 19.

The first springs of FIGS. 1-3 are both compressible and stretchable while generating a spring force for forcing the pistons back to their closed positions once the pump is deactivated. In FIG. 5, the first springs are compressed when the pistons move away from the pump (in the jetting mode) and the second springs are compressed when the pistons move towards the pump (in the sampling mode).

In FIGS. 1-5, the chamber wall 10 was provided with grooves and in FIG. 6, the chamber wall comprises two first circumferential protrusions 26 arranged opposite one of the pistons in a closed position of the piston, providing a seal between two chamber sections. Once the pistons in FIG. 6 move towards or away from the pump, fluid is allowed to pass the pistons along their circumferences. This is due to the fact that the first circumferential protrusions taper towards the first and the second ends of the chamber.

Furthermore, the multifunctional downhole wireline tool 1 shown in FIG. 6 is provided with a projection 35 at the second end of the piston rods connecting the second spring with the second end and preventing the second spring from leaving the second end of the piston rod when the second spring is compressed.

Figure 7:
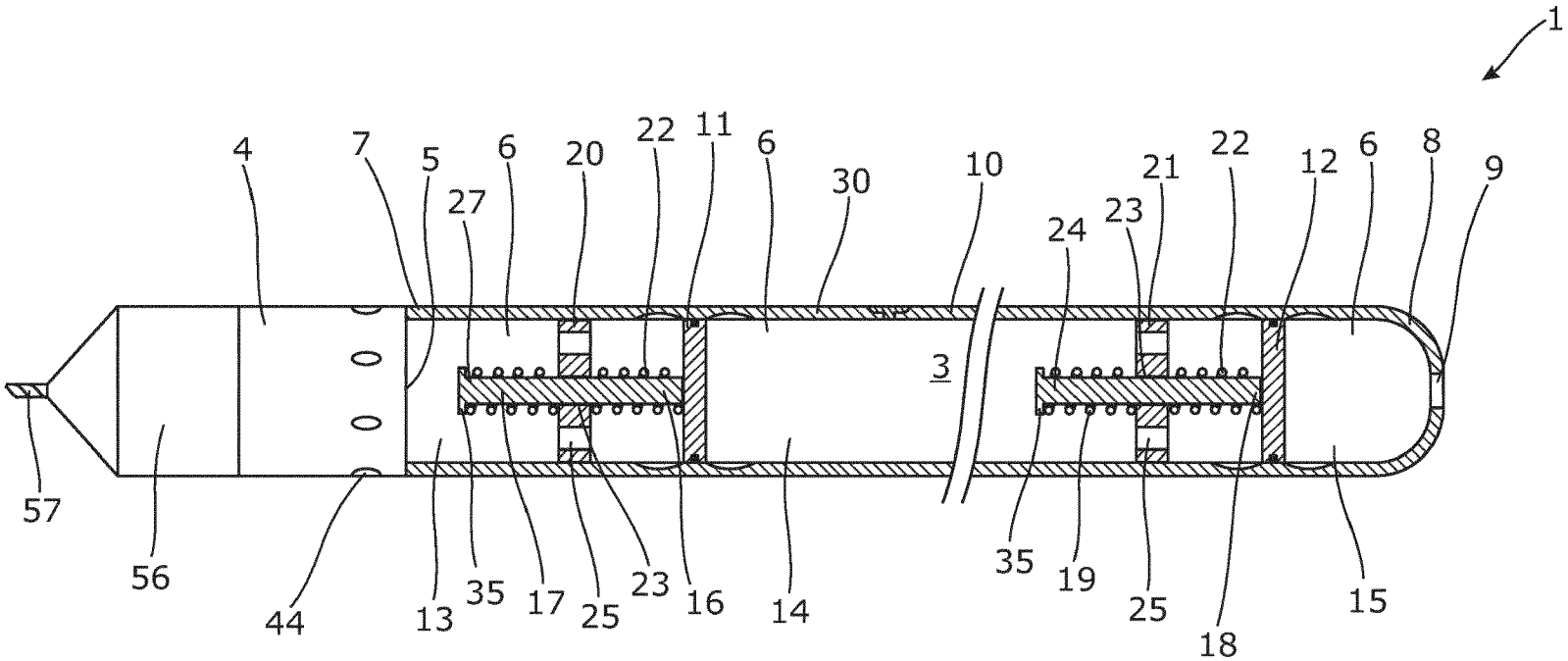
FIG. 7 shows a cross-sectional view of yet another multifunctional downhole wireline tool.

In FIG. 7, the first support 20 is arranged in the first chamber section 13, and the second support 21 is arranged in the second chamber section 14. The chamber wall is provided with the same grooves 27 as illustrated in the cross-sectional view of FIG. 4.

Figure 8:
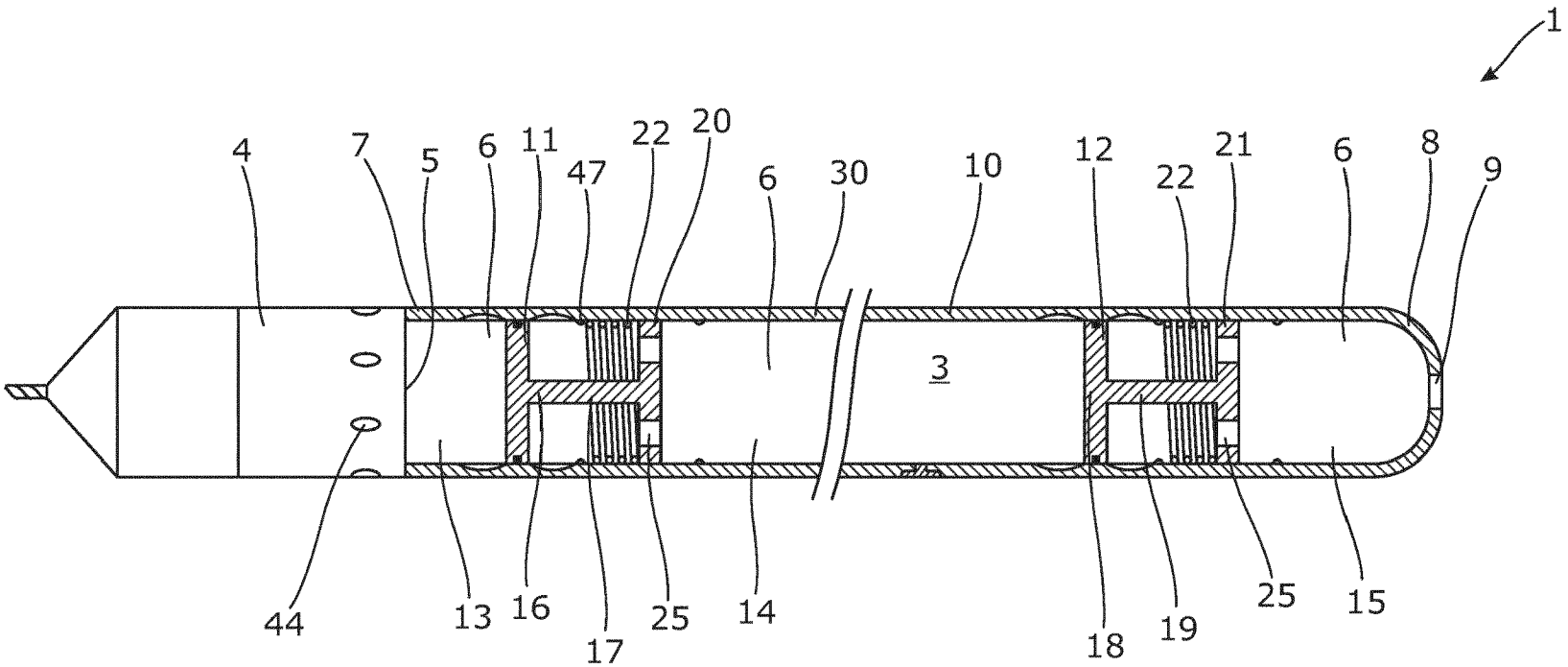
FIG. 8 shows a cross-sectional view of yet another multifunctional downhole wireline tool.

The supports in FIG. 8 is connected to the second ends of the piston rods, and the first springs are connected to a projection 47 in the chamber wall 10 and the supports, so that the spring provides both a retractable and compressible spring force. Thus, the supports move along with the pistons in FIG. 8.

Figure 9:
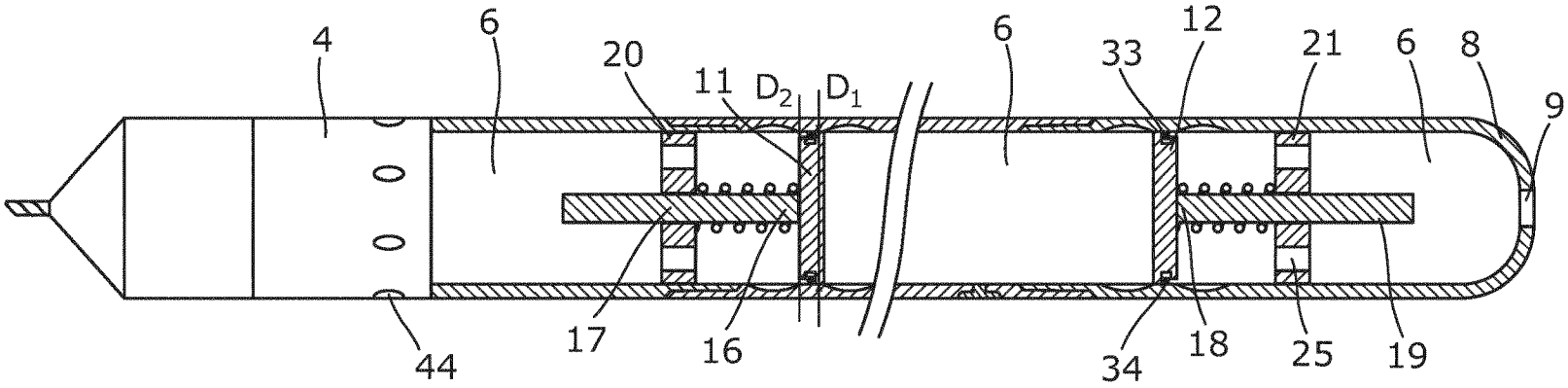
FIG. 9 shows a cross-sectional view of yet another multifunctional downhole wireline tool having a special piston design as shown in FIG. 10.
Figure 10:
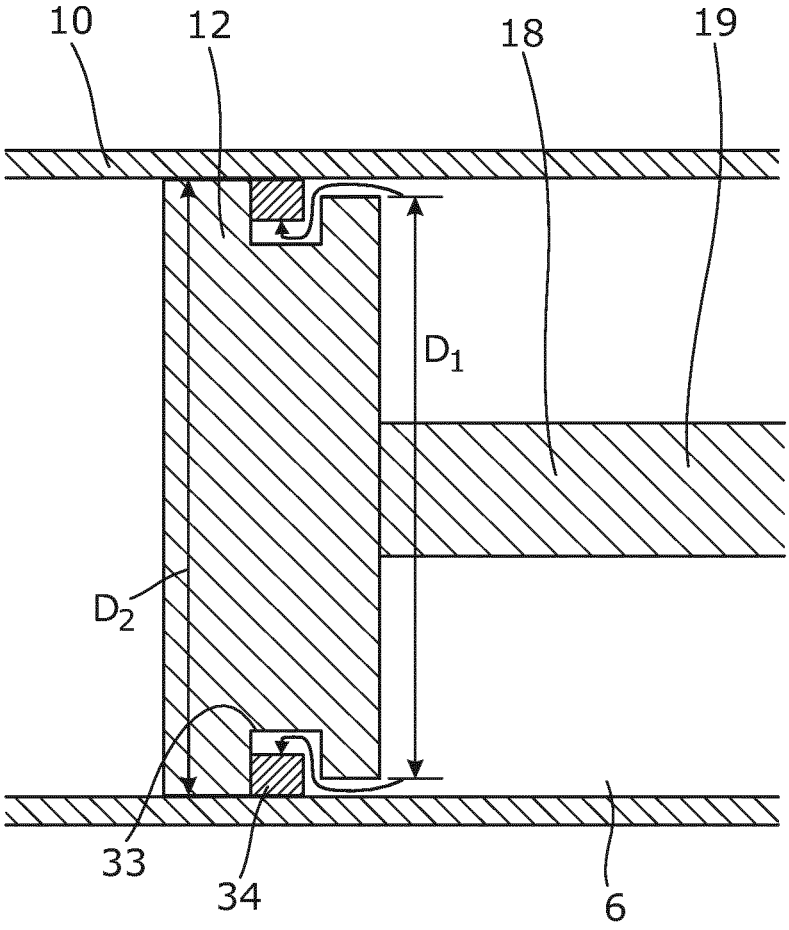

In FIG. 9, the first and second pistons 11, 12 have a first piston diameter $D_1$ nearest the ends of the fluid chamber and a second piston diameter $D_2$ nearest the second chamber section. The pistons are provided with a circumferential groove 33 in which a sealing element 34 is arranged. Thus, the groove is arranged between the first diameter and the second diameter. The first piston diameter is smaller than the second piston diameter, allowing fluid from the second chamber to pass the first piston diameter and force the sealing element towards the chamber wall, as illustrated in the enlarged view of FIG. 10.

Having a first piston diameter which is smaller than the second piston diameter, the fluid sample having a pressure which is substantially higher than the well fluid pressure as the tool returns to the top of the well, helps press the sealing element outwards, thus providing a better seal between the second chamber section and the other chamber sections, as the pressure difference between the fluid sample and the surrounding well fluid increases.

Figure 12:
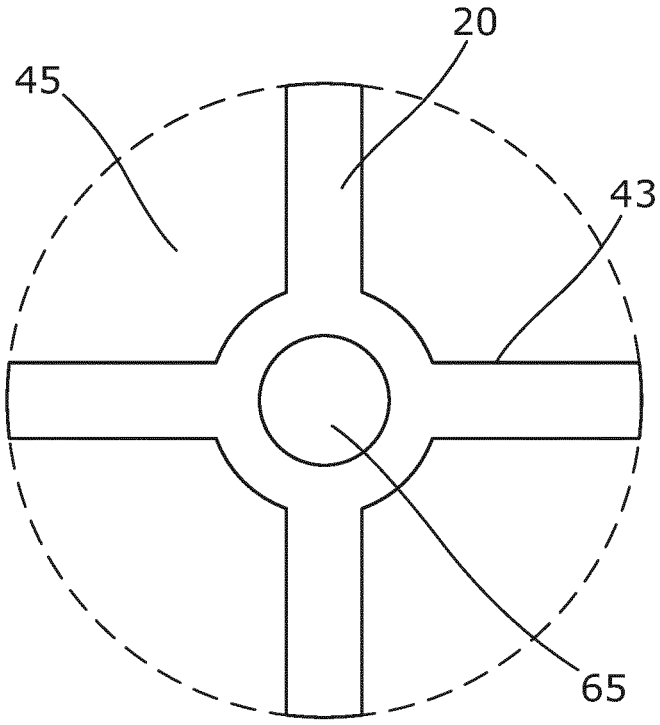
FIG. 12 shows a support for supporting the piston rods.

In FIG. 12, a first support 20 having recesses 43 is shown. The recesses 43 form together with the tool housing, which is illustrated with dotted lines, fluid passages 45, so that fluid can pass the support when the support is arranged in the tool housing. The second support is identical to the first support shown in FIG. 12.

As can be seen in FIG. 5, a shear pin or a shear disc is arranged in a groove in the piston rod preventing the piston from unintentional sliding until a certain pressure is reached, where the shear pin or disc shears and the piston is allowed to slide. During the travel of the tool down the well tubular structure or down the production casing, the tool may bump into restrictions, nipples etc., and by having the shear pin or the shear disc, the pistons do not move unintentionally during those bumps and the fluid entrapped in the second chamber does therefore not leak.

Furthermore, an inner face of the chamber and a face of the pistons may comprise a layer of ceramics, such as $S_iO$ or glass. The chamber is thus able to carry acid or corrosive fluid.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

Figure 11:
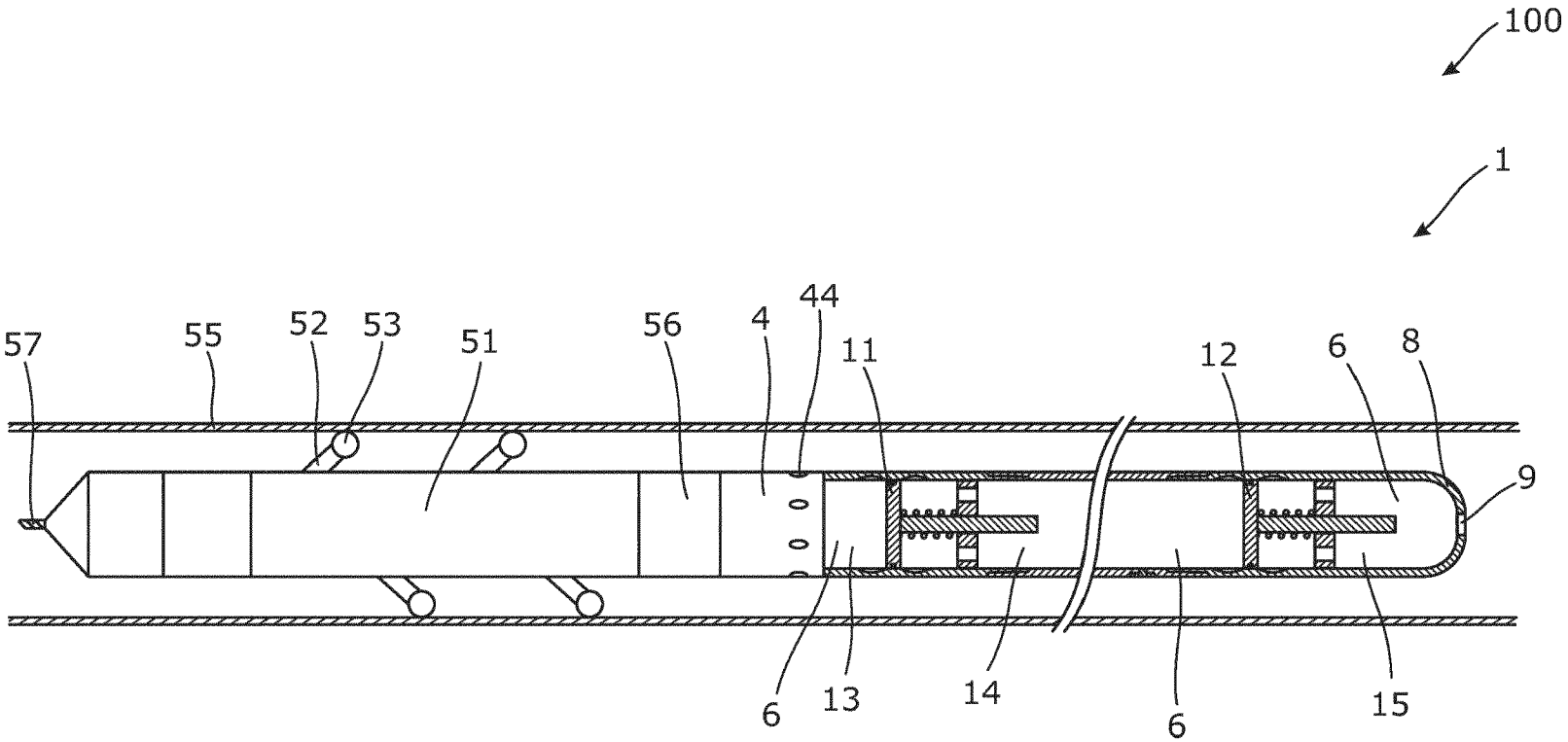
FIG. 11 shows a downhole system.

In the event that the tool is not submergible all the way into the casing, a driving unit 51, such as a downhole tractor, can be used to push the tool all the way into position in the well, as shown in FIG. 11 for propelling the downhole system 100 forward in the well or casing 55. The downhole tractor may have projectable arms 52 having wheels, wherein the wheels 53 contact the inner surface of the casing 55 for propelling the tractor and the tool forward in the casing. A downhole tractor is any kind of driving tool capable of pushing or pulling tools in a well downhole, such as a Well Tractor®.

By a casing, production casing or well tubular structure is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A multifunctional downhole wireline tool for fluid sampling and fluid jetting in a well downhole, comprising:

a pump having a pump opening, and a fluid chamber for collecting a sample of fluid or storage of fluid to be jetted, the fluid chamber having a first chamber end connected with the pump opening and a second chamber end having a chamber opening, wherein the fluid chamber has a chamber wall and comprises:

a first piston and a second piston dividing the fluid chamber into a first chamber section, a second chamber section and a third chamber section, the first piston being connected with a first end of a first piston rod, the second piston being connected with a first end of a second piston rod, a first support configured to support the first piston rod, a second support configured to support the second piston rod, and a first spring provided between the first piston and the first support and another first spring provided between the second piston and the second support, so that when the pump provides a pressure difference over the pistons, the pistons are forced in one direction, hence activating a spring force of the first springs and allowing the fluid to flow from one chamber section to another chamber section.

2. A multifunctional downhole wireline tool according to claim 1, wherein the pump provides a suction pressure in the first chamber section, and the piston is forced in the one direction towards the pump, allowing the fluid to flow from the second chamber section to the first chamber section and from the third chamber section to the second chamber section, respectively.

3. A multifunctional downhole wireline tool according to claim 1, wherein the pump provides a compressive pressure in the first chamber section, and the piston is forced in an opposite direction away from the pump, allowing the fluid to flow from the first chamber section to the second chamber section and from the second chamber section to the third chamber section, respectively.

4. A multifunctional downhole wireline tool according to claim 1, further comprising a second spring abutting the supports and connected with a second end of the piston rods.

5. A multifunctional downhole wireline tool according to claim 4, wherein the piston is arranged at one side of the support and the first end of the piston rod penetrates an aperture in the support, the second end of the piston rod being arranged at an opposite side of the support.

6. A multifunctional downhole wireline tool according to claim 1, wherein each support has at least one through-bore allowing fluid to flow from one chamber section to another.

7. A multifunctional downhole wireline tool according to claim 1, wherein the chamber wall comprises at least a first circumferential protrusion arranged opposite one of the pistons in a closed position of the piston, providing a seal between two chamber sections.

8. A multifunctional downhole wireline tool according to claim 7, wherein the at least first circumferential protrusion tapers towards the first and second ends of the chamber.

9. A multifunctional downhole wireline tool according to claim 1, wherein the chamber wall comprises at least one groove arranged along a longitudinal extension of the fluid chamber, the groove being arranged opposite the piston in an open position of the piston where fluid is allowed to flow from one chamber section to another.

10. A multifunctional downhole wireline tool according to claim 1, wherein a tool housing defining the chamber wall comprises at least two housing parts, which housing parts are detachably connected to each other opposite the second chamber section.

11. A multifunctional downhole wireline tool according to claim 1, wherein the second chamber section has an outlet provided with a detachable plug for taking out the sample at surface or filling the second chamber section with the fluid to be jetted.

12. A multifunctional downhole wireline tool according to claim 1, wherein the pistons have a first piston diameter nearest the ends of the fluid chamber, a second piston diameter nearest the second chamber section, a circumferential groove arranged between the first piston diameter and the second piston diameter, and a sealing element arranged in the groove, the second piston diameter being smaller than the first piston diameter, allowing fluid from the second chamber to pass the second piston diameter and force the sealing element towards the chamber wall.

13. A multifunctional downhole wireline tool according to claim 1, wherein the first and second pistons are spaced from the first and second supports, respectively, and one of the first and second pistons is positioned and spaced from both the first support and the second support.

14. A multifunctional downhole wireline tool according to claim 1, wherein the first and second pistons are separate from and independent from one another.

15. A downhole system for fluid sampling and fluid jetting in a well downhole, comprising:

a multifunctional downhole wireline tool according to claim 1, and a downhole driving unit, such as a downhole tractor for propelling the system forward in the well.

16. A sampling method using a multifunctional downhole wireline tool according to claim 1, comprising:

arranging the tool in the well at a predetermined position, providing a suction pressure in the first chamber section by means of the pump, forcing the first piston towards from the pump allowing well fluid from the second chamber section into the first chamber section, and forcing the second piston towards the pump, allowing well fluid from the third chamber section into the second chamber section, sucking well fluid through the opening in the second end of the fluid chamber into the third chamber section and further into the second chamber section.

17. A jetting method using a multifunctional downhole wireline tool according to claim 1, comprising:

filling the second chamber section with fluid, arranging the tool in the well at a predetermined position, providing a compressive pressure in the first chamber section by means of the pump, forcing the first piston away from the pump, allowing well fluid from the pump into the second chamber section, and forcing the second piston away from the pump, allowing well fluid from the second chamber section into the third chamber section and out through the opening in the second end of the fluid chamber.

* * * * *